US007908985B2

(12) United States Patent
Okuyama

(10) Patent No.: US 7,908,985 B2
(45) Date of Patent: Mar. 22, 2011

(54) SEWING MACHINE AND COMPUTER-READABLE RECORDING MEDIUM STORING THREAD AMOUNT PROCESSING PROGRAM

(75) Inventor: Tsuneo Okuyama, Inabe-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 534 days.

(21) Appl. No.: 12/073,253

(22) Filed: Mar. 3, 2008

(65) Prior Publication Data

US 2008/0223274 A1 Sep. 18, 2008

(30) Foreign Application Priority Data

Mar. 13, 2007 (JP) ..... 2007-062827

(51) Int. Cl.
*D05B 21/00* (2006.01)

(52) U.S. Cl. ..... 112/102.5

(58) Field of Classification Search ..... 112/102.5, 112/78, 84, 103; 700/138, 135, 136, 137, 700/130

See application file for complete search history.

(56) References Cited

U.S. PATENT DOCUMENTS

| | | | | |
|---|---|---|---|---|
| 4,166,423 | A | 9/1979 | Brienza et al. | |
| 5,353,726 | A | 10/1994 | Bruder et al. | |
| 6,012,402 | A * | 1/2000 | Sekine | 112/102.5 |
| 6,629,015 | B2 * | 9/2003 | Yamada | 700/138 |
| 7,228,195 | B2 | 6/2007 | Hagino | |
| 7,762,202 | B2 * | 7/2010 | Kishi et al. | 112/102.5 |
| 2006/0290493 | A1 | 12/2006 | Taki | |

FOREIGN PATENT DOCUMENTS

| | | |
|---|---|---|
| JP | A-54-159045 | 12/1979 |
| JP | A-5-92089 | 4/1993 |
| JP | A-8-131676 | 5/1996 |
| JP | A-8-141234 | 6/1996 |
| JP | B2-3041046 | 3/2000 |
| JP | A-2004-30152 | 1/2004 |
| JP | A-2005-46633 | 2/2005 |
| JP | A-2005-95367 | 4/2005 |
| JP | A-2005-102915 | 4/2005 |
| JP | A-2005-215959 | 8/2005 |
| JP | A-2005-215960 | 8/2005 |
| JP | A-2006-87502 | 4/2006 |

* cited by examiner

*Primary Examiner* — Tejash Patel
(74) *Attorney, Agent, or Firm* — Oliff & Berridge, PLC

(57) ABSTRACT

A sewing machine capable of sewing an embroidery pattern based on embroidery data including at least thread color data and needle drop point data. The sewing machine includes a reader that reads out thread information stored in an RFID tag embedded in each of a plurality of thread spools, a selection device that selects the embroidery pattern, a thread color-and-amount acquisition device that acquires a necessary thread color and a necessary thread amount from the embroidery data of a selected pattern. The sewing machine also includes a comparison device that compares a read out thread amount with the necessary thread amount, a determination device that determines whether sewing the selected pattern is possible based on a comparison result by the comparison device, and an indication device that indicates a determination result by the determination device.

4 Claims, 14 Drawing Sheets

FIG. 5

1031

| ID | COLOR | THREAD AMOUNT (m) |
|---|---|---|
| 1 | RED | 5 |
| 2 | PINK | 30 |
| 3 | BLUE | 100 |
| 4 | YELLOW GREEN | 20 |
| 5 | WHITE | 1 |
| 6 | BLACK | 20 |
| 7 | SALMON PINK | 30 |
| 8 | GREEN | 3 |

FIG. 6

1032

| COLOR | THREAD AMOUNT (m) |
|---|---|
| PINK | 5 |
| DEEP PINK | 3 |
| YELLOW GREEN | 10 |
| GREEN | 2 |
| | |

FIG. 12

1032

| COLOR | THREAD AMOUNT (m) |
|---|---|
| PINK | 5 |
| SALMON PINK | 3 |
| YELLOW GREEN | 10 |
| GREEN | 2 |
| | |

FIG. 14

1031

| ID | COLOR | THREAD AMOUNT (m) |
|---|---|---|
| 1 | RED | 5 |
| 2 | PINK | 25 |
| 3 | BLUE | 100 |
| 4 | YELLOW GREEN | 10 |
| 5 | WHITE | 1 |
| 6 | BLACK | 20 |
| 7 | SALMON PINK | 27 |
| 8 | GREEN | 1 |

SEWING MACHINE AND COMPUTER-READABLE RECORDING MEDIUM STORING THREAD AMOUNT PROCESSING PROGRAM

CROSS-REFERENCE TO RELATED APPLICATION

This application claims priority to JP2007-062827, filed Mar. 13, 2007, the content of which is hereby incorporated herein by reference in its entirety.

BACKGROUND

The present disclosure relates to a sewing machine and a computer-readable recording medium storing a thread amount processing program.

Generally, threads that are used in a sewing machine vary widely in color, material, size, etc. A user always has to check whether a desired thread for sewing is attached to a sewing machine. For this purpose, an apparatus, which automatically determines a color of an attached upper thread, is proposed (e.g., Japanese Laid-Open Patent Publication No. Hei 5-92089). If a thread attached to a sewing machine runs out during sewing, a user needs to replace a thread spool or replenish a thread on a bobbin for a lower thread. Especially, it is difficult to see and determine the remaining amount of a lower thread, so that an apparatus that automatically monitors the remaining amount of the lower thread is also proposed (e.g., Japanese Patent No. 3041046).

When a user sews a pattern such as an embroidery pattern with a sewing machine, many colors of threads may be used. In such a case, the user needs to check whether threads available are sufficient to sew all colors of a pattern and whether a sufficient amount of threads remains. Use of many threads makes checking complicated.

The aforementioned conventional sewing machine with an automatic upper thread determining function is capable of only determining a color of an upper thread that is currently attached in the sewing machine. Even the aforementioned lower thread remaining amount monitor is capable of only detecting a remaining amount of a lower thread that is currently attached. Therefore, a user cannot check whether the user has multiple threads of different colors and the amounts necessary to sew a desired pattern.

SUMMARY

Various exemplary examples of the broad principles derived herein provide a sewing machine and a computer-readable recording medium storing a thread amount processing program that can determine whether the threads available are sufficient in thread colors and in amounts to sew a desired pattern.

Exemplary examples provide a sewing machine capable of sewing an embroidery pattern based on embroidery data including at least thread color data and needle drop point data. The thread color data identifies a color of an embroidery thread, and the needle drop point data identifies a sewing position. The sewing machine includes a reader that reads out thread information stored in an RFID tag embedded in each of a plurality of thread spools. The thread information includes at least a thread color and the amount of thread that is wound around each of the plurality of thread spools. The sewing machine includes a selection device that selects the embroidery pattern. The sewing machine includes a thread color-and-amount acquisition device that acquires a necessary thread color and a necessary thread amount from the embroidery data of a selected pattern. The necessary thread color is a thread color to be used for the selected pattern, the necessary thread amount is a thread amount to be used for the selected pattern, and the selected pattern is the embroidery pattern selected by the selection device The sewing machine includes a comparison device that compares a read out thread amount with the necessary thread amount. The read out thread amount is the thread amount read out by the reader for each of the plurality of thread spools, and the necessary thread amount is acquired by the thread color-and-amount acquisition device for the necessary thread color. The sewing machine includes a determination device that determines whether sewing the selected pattern is possible based on a comparison result by the comparison device, and includes an indication device that indicates a determination result by the determination device.

Exemplary examples provide a computer-readable recording medium storing a thread amount processing program. The program causes a controller to perform a thread color-and-amount acquisition step of acquiring a necessary thread color and a necessary thread amount from embroidery data including thread color data and needle drop point data for a selected embroidery pattern. The necessary thread color is a thread color to be used for the selected embroidery pattern, the necessary thread amount is a thread amount to be used for the selected embroidery pattern, the thread color data identifies a color of an embroidery thread, and the needle drop point data identifies a sewing position. A comparison step compares a read out thread amount with the necessary thread amount. The read out thread amount is a thread amount read out from an RFID tag for each of a plurality of thread spools. The necessary thread amount is acquired in the thread color-and-amount acquisition step for each necessary thread colors. The RFID tag is embedded in each of the plurality of thread spools and storing thread information includes at least a thread color and a thread amount of a thread wound around each of the plurality of thread spools. A determination step of determining whether sewing the selected pattern is possible based on a comparison result in the comparison step, and an indication step of indicating a determination result in the determination step.

BRIEF DESCRIPTION OF THE DRAWINGS

Exemplary examples will be described below in detail with reference to the accompanying drawings in which:

FIG. 5 is a table showing a configuration of a first thread information storage area of the RAM;

FIG. 6 is a table showing a configuration of a second thread information storage area of the RAM;

FIG. 12 is a table showing thread information on threads to be used for an embroidery pattern which is stored in the second thread information storage area;

FIG. 14 is a table showing an example of the first thread information storage area in which thread information is updated after sewing.

DETAILED DESCRIPTION

Figure 1:
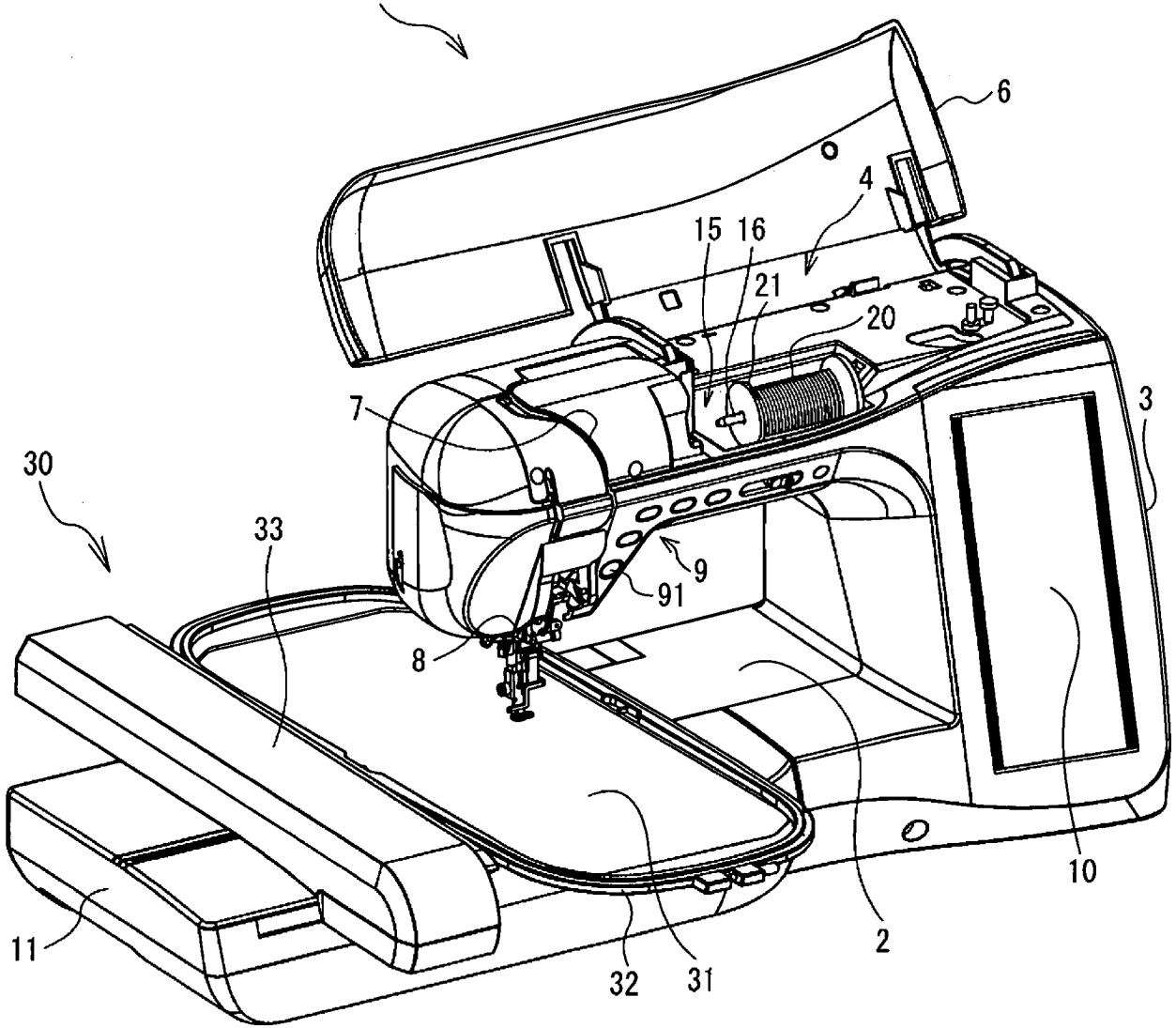
FIG. 1 is a perspective view of a sewing machine.

The following will describe an exemplary example of a sewing machine 1 that embodies the present disclosure with reference to the drawings. The drawings are provided for describing technical features that can be employed. The configurations of the apparatus and the flowcharts of various processing that are illustrated in the drawings are not intended to limit the scope of the invention to the particular configurations or processes but are merely examples for description, unless otherwise specified.

Figure 2:
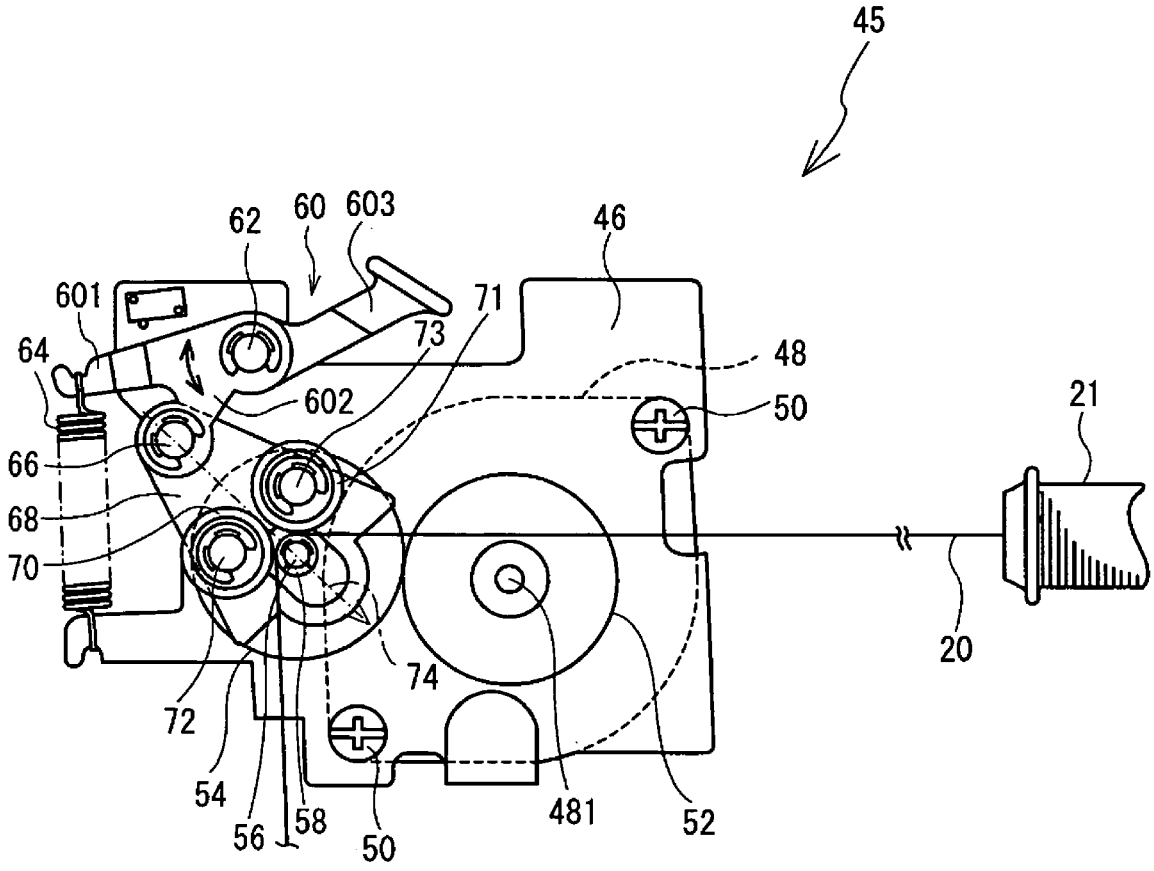
FIG. 2 is a plan view of an upper thread amount detecting device of the sewing machine.

The following will describe a physical configuration of the sewing machine 1 according to the present example with reference to FIGS. 1 and 2. In FIG. 1, the front side of the sheet is referred to as "front side of the sewing machine 1" and the rear side of the sheet is referred to as "rear side of the sewing machine 1". The right and left directions of the sewing machine 1 as viewed from a user are referred to as "right and left directions," respectively. As shown in FIG. 1, the sewing machine 1 includes a bed 2, a pillar 3, and an arm 4. The pillar 3 is erected upward at the right end of the bed 2. The arm 4 extends leftward from the upper end of the pillar 3 so as to face to the bed 2.

The bed 2 is equipped with a needle plate (not shown). A shuttle mechanism (not shown), in which a detachable bobbin for a lower thread (not shown) can be installed, is provided under the needle plate. Under the needle plate are also provided a feed dog (not shown), a cloth feed mechanism (not shown), and a feed adjustment pulse motor 132 (see FIG. 3). The feed dog feeds a work cloth to be sewn by a predetermined feed distance. The cloth feed mechanism drives the feed dog. The feed adjustment pulse motor 132 adjusts a feed distance. At the right end inside the bed 2 (in the lower end of the pillar 3), a sewing machine motor 133 (see FIG. 3) is equipped. The drive power from the sewing machine motor 133 is transmitted via a drive belt (not shown) to a pulley (not shown) and a drive shaft (not shown). The drive shaft extends leftward from the pulley through the arm 4. The drive power from the sewing machine motor 133 is transmitted also to a lower shaft (not shown) to drive the cloth feed mechanism and the shuttle mechanism. The aforementioned configuration enables a needle bar 8, a thread take-up mechanism (not shown), the shuttle mechanism, the feed dog, etc., to be driven synchronously. Consequently, sewing a utility stitch pattern, which is not an embroidery pattern, can be carried out.

A detachable embroidery unit 30 is attached to the bed 2. The embroidery unit 30 moves an embroidery frame 32, in which a work cloth 31 is set, in a longitudinal (front-and-rear) direction and in a lateral (right-and-left) direction. The embroidery unit 30 is equipped with a longitudinal movement mechanism (not shown), a lateral movement mechanism (not shown), an X-axis motor 136 (see FIG. 3), and a Y-axis motor 137 (see FIG. 3). The longitudinal movement mechanism is disposed under a carriage cover 33 and drives a carriage (not shown) so that the carriage may move in the longitudinal direction (in the front-and-rear directions). To the carriage, the detachable embroidery frame 32 is attached. The lateral movement mechanism is disposed under a body cover 11 and drives the longitudinal movement mechanism so that the longitudinal movement mechanism may move in the lateral direction (in the right-and-left directions). The X-axis motor 136 drives the lateral movement mechanism. The Y-axis motor 137 drives the longitudinal movement mechanism. An embroidery pattern can be sewn on the work cloth 31 with the embroidery frame 32 moved by the longitudinal movement mechanism and the lateral movement mechanism and with the needle bar 8 and the shuttle mechanism driven synchronously. Although not described in detail, when the embroidery pattern is sewn, a feed dog retracting mechanism (not shown) holds the feed dog in a retracted position below the needle plate.

As shown in FIG. 1, the pillar 3 is equipped with a vertically long liquid crystal display (LCD) 10. On the LCD 10, various messages and function names to perform various functions necessary in sewing, such as the setting and the editing of a pattern, are displayed. The LCD 10 has a touch panel 111 (see FIG. 3). If an item displayed on the LCD 10 is selected with a finger or a dedicated pen, the selection of the item may be detected by the touch panel 111. Thus, the user can enter various instructions on the LCD 10. On the right side surface of the pillar 3, a connector 108 (see FIG. 3) is provided. Through the connector 108, it is possible to input various data and programs into the sewing machine 1 and also output various data and programs from the sewing machine 1.

On the upper part of the arm 4, a top cover 6 is provided along the whole length of the arm 4 in a lateral direction. The top cover 6 is pivotally supported on the upper rear part of the arm 4 so that the top cover 6 may be opened and closed around an axis along the lateral direction of the arm 4. As shown in FIG. 1, under the top cover 6, a thread spool holder 15, which is a recess, is provided in the middle upper side of the arm 4. In the thread spool holder 15, a thread spool 21 wound with an upper thread 20 is set. A spool pin 16 extends leftward from the right side of the thread spool holder 15 in parallel with the arm 4. The spool pin 16 supports the thread spool 21 so that the thread spool 21 can rotate. At the lower part of an end portion of the arm 4, which is opposite to the side where the arm 4 is connected to the pillar 3, a needle bar 8 is provided. A sewing needle is attached to the needle bar 8. The arm 4 is provided with a thread guide groove 7 and an upper thread amount detecting device 45 (see FIG. 2). The thread guide groove 7 leads an upper thread 20 that may be pulled from the thread spool 21 to a sewing needle along a guide path via a tension mechanism (not shown), a thread take-up spring (not shown), and a thread take-up lever. The arm 4 is equipped with a radio frequency identification (RFID) reader/writer 510 (see FIG. 3). The RFID reader/writer 510 reads information from an RFID tag 801 (see FIGS. 7-9) that may be embedded in the thread spool 21. On the front surface of the arm 4, a plurality of operation keys 9, that may include a start/stop key 91 are provided. The start/stop key 91 is used for an instruction to start or stop the sewing operation. The plurality of operation keys 9 may be used for instructions of various sewing operations.

The following will describe the upper thread amount detecting device 45 provided inside the arm 4 with reference to FIG. 2. The upper thread amount detecting device 45 is provided on the guide path leading from the thread spool 21 to the tension mechanism (not shown). The upper thread amount detecting device 45 detects an upper thread amount of the upper thread 20 that is pulled from the thread spool 21.

As shown in FIG. 2, an encoder 48 is mounted with screws 50 to a mounting board 46 of the upper thread amount detecting device 45. A first gear 52 is fixed to a rotation shaft 481 of the encoder 48. A second gear 54 meshing with the first gear 52 is rotatably supported to the mounting board 46 by a rotation shaft 56. A roller 58 is fixed to the second gear 54 so as to rotate integrally with the second gear 54.

A swing lever 60 is swingably supported by a pivot shaft 62 fixed to the mounting board 46. The swing lever 60 includes a first arm 601, a second arm 602, and a third arm 603. A tension spring 64 is provided so as to couple the first arm 601 with the mounting board 46. Therefore, the swing lever 60 is always biased to swing counterclockwise. One end of a roughly triangular roller holder 68 is swingably supported by a pivot shaft 66 on the second arm 602. The roller 58 passes through an ellipse that is formed in the other end of the roller holder 68.

In the vicinity of the other end of the roller holder 68, rubber-made driven rollers 70 and 71 are rotatably supported by pivot shafts 72 and 73, respectively. Each of the pivot shafts 72 and 73 is fixed to the roller holder 68. Because the swing lever 60 is biased to swing counterclockwise, the pair of driven rollers 70 and 71 is biased via the roller holder 68 in a direction of an arrow 74 so that the driven rollers 70 and 71 may be pressed against the roller 58.

The third arm 603 is operatively coupled with a presser bar (not shown). To the lower end of the presser bar, a presser foot (not shown) is attached. When an operation lever (not shown) which is used to raise and lower the presser foot is operated so as to raise the presser foot to a rest position, the swing lever 60 swings clockwise against the spring force of the tension spring 64, so that the pair of driven rollers 70 and 71 separate from the roller 58.

To lead the upper thread 20 through a predetermined guide path from the thread spool 21, the operation lever is operated to raise the presser foot to the rest position, so that the pair of driven rollers 70 and 71 is separated from the roller 58. Further, tension discs (not shown) of the tension mechanism are also separated so that the upper thread 20 can be passed through. In this condition, if the upper thread 20 is stretched along the predetermined guide path, the upper thread 20 may be passed between the pair of driven rollers 70 and 71 and the roller 58. Next, if the operation lever is operated to lower the presser foot to a sewing position, the upper thread 20 may be held between the pair of driven rollers 70 and 71 and the roller 58.

As the upper thread 20 is pulled out for sewing, the roller 58 rotates. A rotation of the roller 58 may be transmitted to the encoder 48 via the second gear 54 and the first gear 52. The number of rotations detected by the encoder 48 may be used to calculate the number of rotations of the roller 58. Thus, the amount of the upper thread 20 that is pulled out can be detected.

Figure 3:
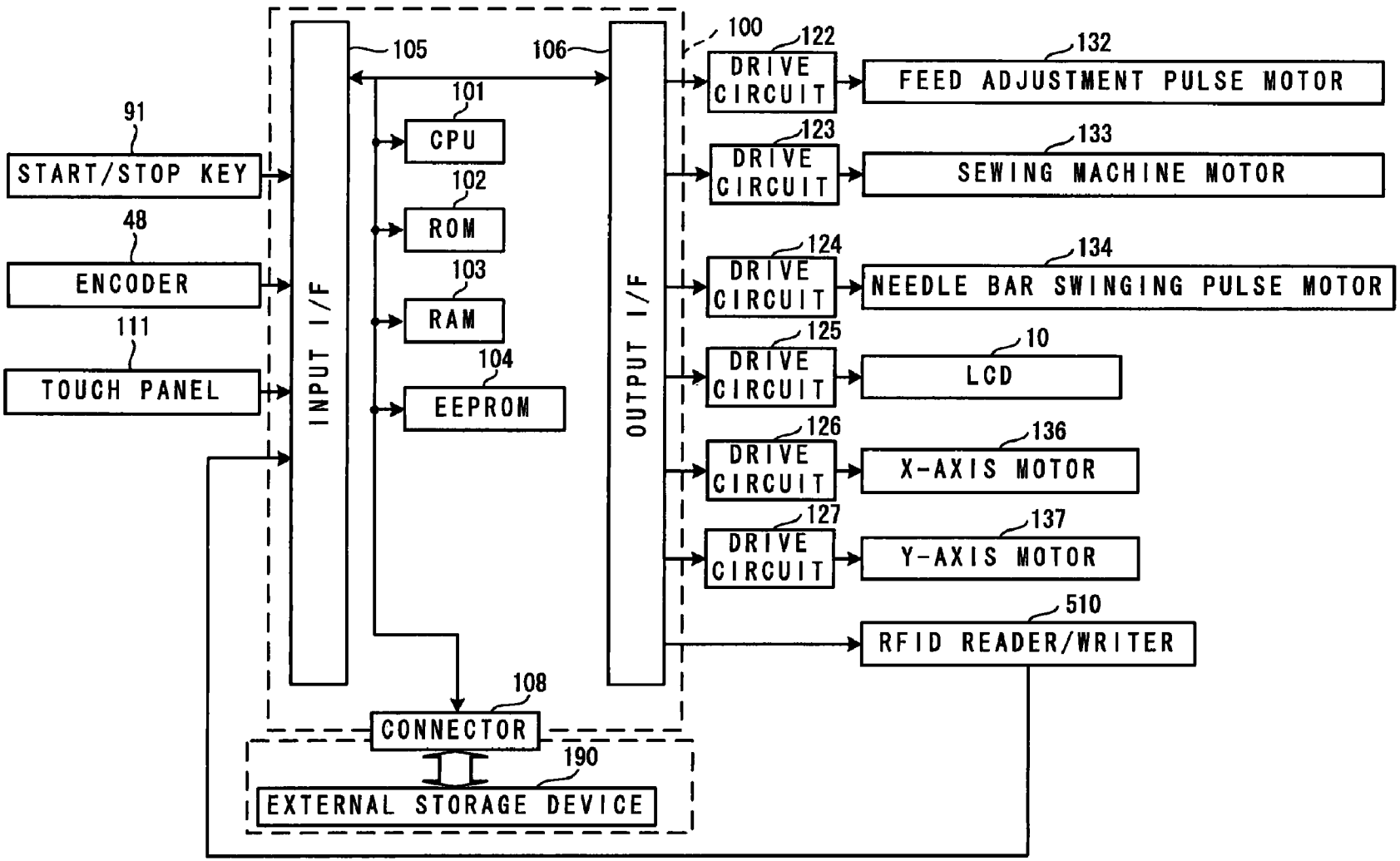
FIG. 3 is a block diagram showing an electrical configuration of the sewing machine.

The electrical configuration of the sewing machine 1 will be described below with reference to FIG. 3. As shown in FIG. 3, a control section 100 is a central part of a control system of the sewing machine 1. The control section 100 includes a CPU 101, a ROM 102, a RAM 103, an EEPROM 104, an input interface (I/F) 105, an output I/F 106, and a connector 108, which are connected to each other via a bus. Connected to the input I/F 105 are the start/stop key 91 (see FIG. 1), the encoder 48, the touch panel 111, and the RFID reader/writer 510. Connected to the output I/F are the RFID reader/writer 510 and drive circuits 122-127, which drive a feed adjustment pulse motor 132, the sewing machine motor 133, a needle bar swinging pulse motor 134, the LCD 10 (see FIG. 1), the X-axis motor 136, and the Y-axis motor 137, respectively. The feed adjustment pulse motor 132 adjusts the feed distance of a work cloth fed by the feed dog. The needle bar swinging pulse motor 134 drives a needle bar swinging mechanism (not shown), which moves the needle bar 8 (see FIG. 1) in the lateral (right-and-left) direction. The X-axis motor 136 drives the lateral movement mechanism, which moves the embroidery frame 32 in the lateral direction. The Y-axis motor 137 drives the longitudinal movement mechanism, which moves the embroidery frame 32 in the longitudinal direction. An external storage device 190, such as a CD-ROM drive, can also be connected to the connector 108.

The CPU 101 in the control section 100 performs main control over the sewing machine 1. The CPU 101 performs various computations and processing in accordance with various programs stored in a program storage area (not shown) in the ROM 102, which is a read only memory. The RAM 103, which is a readable and writable random access memory, has storage areas for temporarily storing various data.

The RFID reader/writer 510 performs wireless communication with an RFID tag 801 (see FIGS. 8 and 9) embedded in the thread spool 21. The RFID reader/writer 501 is any known reader/writer that can read or write information without physically contacting the RFID tag 801. Although not illustrated, the RFID reader/writer 510 includes an antenna, a transmission/reception circuit, a signal processing circuit, and a control circuit. The antenna receives and transmits a signal through wireless communication with an antenna 811 of the RFID tag 801. The transmission/reception circuit is used to access to an IC circuit section 820 of the RFID tag 801 via the antenna to read or write information. The signal processing circuit is used to process a signal read out from the RFID tag 801. The control circuit, which may be a microcomputer, includes a CPU, a ROM, a RAM, etc. The control circuit processes the signal in accordance with the programs stored beforehand in the ROM, using temporary storage areas of the RAM.

Figure 4:
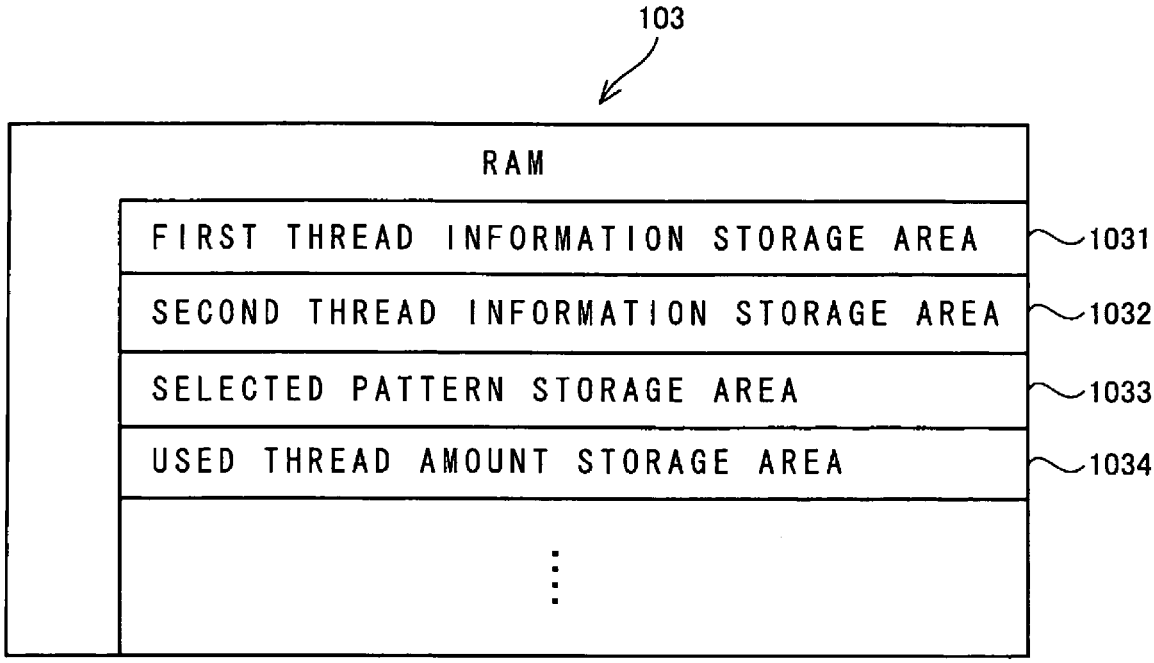
FIG. 4 is a conceptual diagram showing a configuration of a RAM.

The configuration of the RAM 103 will be described below with reference to FIGS. 4-6. As shown in FIG. 4, the RAM 103 includes a first thread information storage area 1031, a second thread information storage area 1032, a selected pattern storage area 1033, and a used thread amount storage area 1034. The first thread information storage area 1031 stores information read out from the RFID tag 801 by the RFID reader/writer 510. The second thread information storage region 1032 stores information on the threads necessary for sewing a embroidery pattern selected by the user, such as thread colors and thread amounts. The selected embroidery pattern storage area 1033 stores the embroidery data of a embroidery pattern to be sewn when the embroidery pattern is selected by the user. The used thread amount storage area 1034 stores a used thread amount detected by the upper thread detection apparatus 45 (encoder 48) in sewing.

As shown in FIG. 5, the first thread information storage area 1031 stores information read out from the RFID tag 801 by the RFID reader/writer 510. A communication range of the RFID reader/writer 510 is set to cover several tens of centimeters around the sewing machine 1. Therefore, the RFID reader/writer 510 can read not only information of an RFID tag 801 embedded in the thread spool 21 mounted on the sewing machine 1, but also can read the information of an RFID tag 801 of each of a plurality of thread spools 21 placed around the sewing machine 1. Thus, the read information, including an ID of the thread spool 21, a thread color of a thread wound around the thread spool 21, and an amount (length) of the thread remaining around the thread spool 21, is stored in the first thread information storage area 1031, as shown in FIG. 5. For simplicity in explanation, the thread colors are herein described by thread names. RGB values of a thread color may be stored in the first thread information storage area 1031.

As shown in FIG. 6, the second thread information storage area 1032 stores thread colors and thread amounts necessary for a embroidery pattern that is selected by the user. The thread colors are included in embroidery data of the selected embroidery pattern. Like the first thread information storage area 1031, RGB values of a thread color may be stored. A thread amount can be calculated from the embroidery data. The embroidery data includes a set of coordinates (X, Y) with which the embroidery frame 32 is moved for respective stitches. Therefore, a thread amount can be calculated from a total sum of movement distances, which are derived from the respective coordinates, and a correction value as some margin. As described later, by comparing the information stored in the first thread information storage area 1031 with the information stored in the second thread information storage area 1032, it is determined whether the selected embroidery pattern can be sewn using thread spools 21 in hand.

The thread spool 21 and the RFID tag 801 that is embedded in the thread spool 21 will be described below with reference to FIGS. 7-9.

Figure 7:
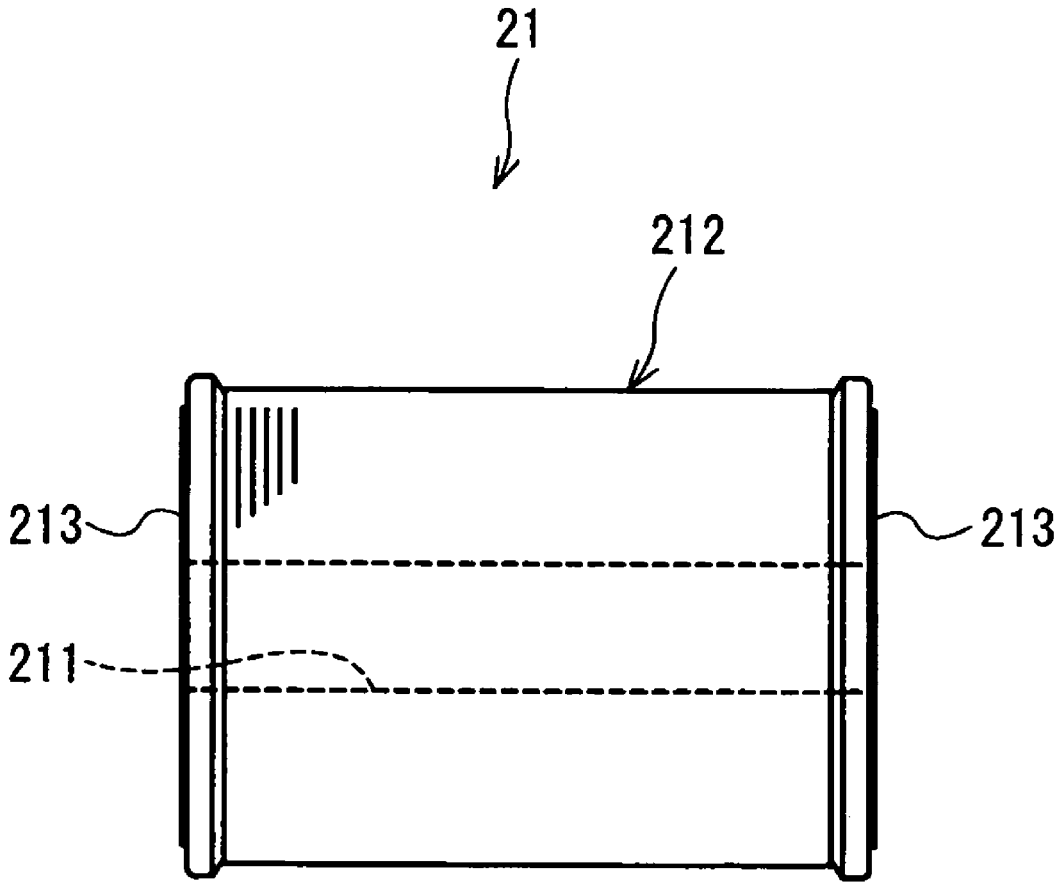
FIG. 7 is an elevation view of a thread spool.
Figure 8:
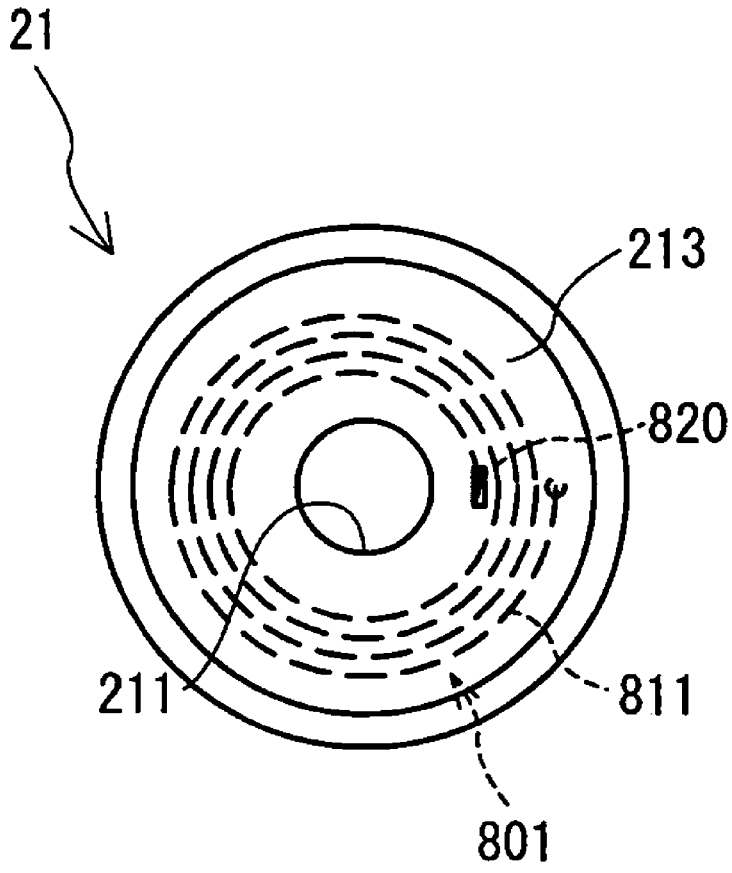
FIG. 8 is a side view of the thread spool.
Figure 9:
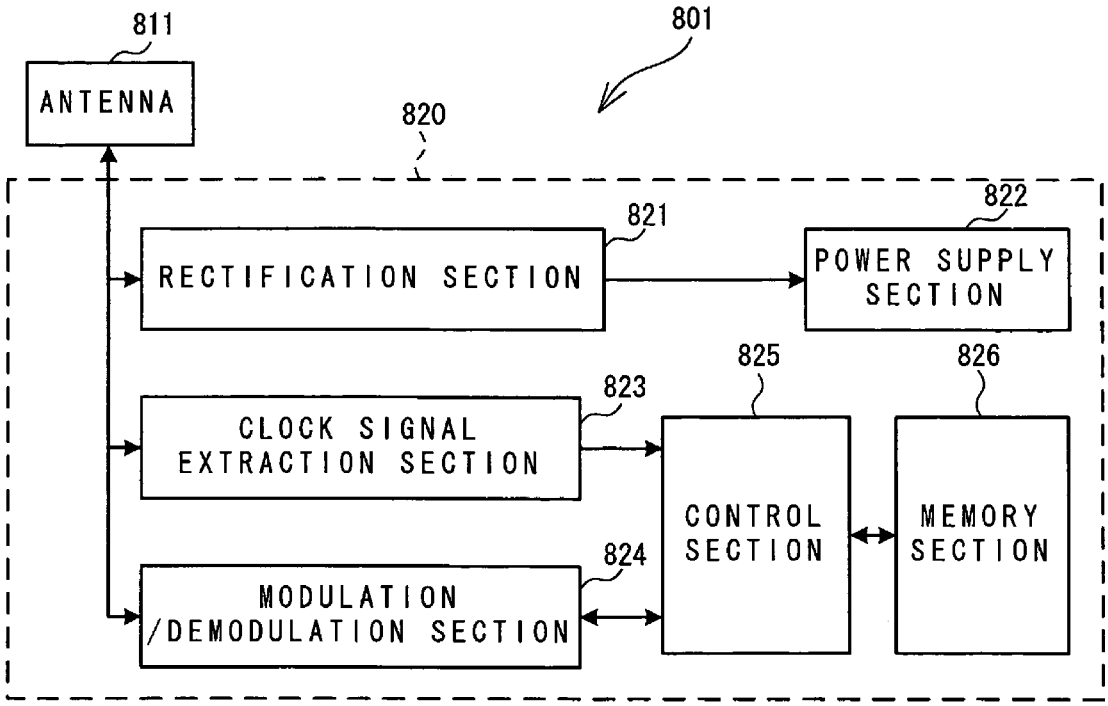
FIG. 9 is a block diagram showing an electrical configuration of an RFID tag.

As shown in FIGS. 7 and 8, the thread spool 21, around which a upper thread is wound, has a cylindrical shaped spool section 212. A hole 211 is formed through the thread spool 21 along a line connecting the centers of two circular surfaces 213, which are two end surfaces of the spool section 212. As shown in FIG. 8, an RFID tag 801 is embedded in one of the circular surfaces 213 of the thread spool 21. The RFID tag 801 includes a coiled antenna 811 and an IC circuit section 820. The antenna 811 is spirally embedded around the hole 211. The IC circuit section 820 is connected to one end of the antenna 811.

The electrical configuration of the RFID tag 801 will be described below. As shown in FIG. 9, the RFID tag 801 includes the antenna 811 and the IC circuit section 820. The antenna 811 is used to transmit or receive a signal to or from an antenna (not shown) of the RFID reader/writer 510, without physical contact, through a radio wave. The IC circuit section 820 includes a rectification section 821, a power supply section 822, a clock signal extraction section 823, a modulation/demodulation section 824, a control section 825, and a memory section 826. The rectification section 821, the clock signal extraction section 823, and the modulation/demodulation section 824 are connected to the antenna. The power supply section 822 is connected to the rectification section 821. The control section 825 is connected to the clock signal extraction section 823 and the modulation/demodulation section 824. The memory section 826 is connected to the control section 825. The rectification section 821 rectifies a carrier wave received by the antenna 811. The power supply section 822 accumulates energy of the carrier wave rectified by the rectification section 821 and the energy is utilized as drive power. The clock signal extraction section 823 extracts a clock signal from a carrier wave received by the antenna 811 and supplies the extracted signal to the control section 825. The modulation/demodulation section 824 demodulates a received signal transmitted in a carrier wave from the RFID reader/writer 510 and received by the antenna 811. Further, the modulation/demodulation section 824 modulates and reflects the carrier wave based on a response signal from the control section 825. The control section 825 controls basic operations of the RFID tag 801. For example, the control section 825 interprets a received signal demodulated by the modulation/demodulation section 824, generates a response signal based on an information signal stored in the memory section 826, and transmits the response signal through the modulation/demodulation section 824 etc. The memory section 826 stores a given information signal. The configured RFID tag 801 can read and write information in response to an interrogation signal from the RFID reader/writer 510. The memory section 826 stores information (thread colors, thread amounts, etc.) of a thread that is wound around the thread spool 21 in which the RFID tag 801 is embedded. Each time when a thread is used, updated thread amount information is transmitted by the RFID reader/writer 510 to be stored in the memory section 826.

Processing which is performed in the sewing machine 1 will be described below with reference to FIGS. 10-14.

Figure 10:
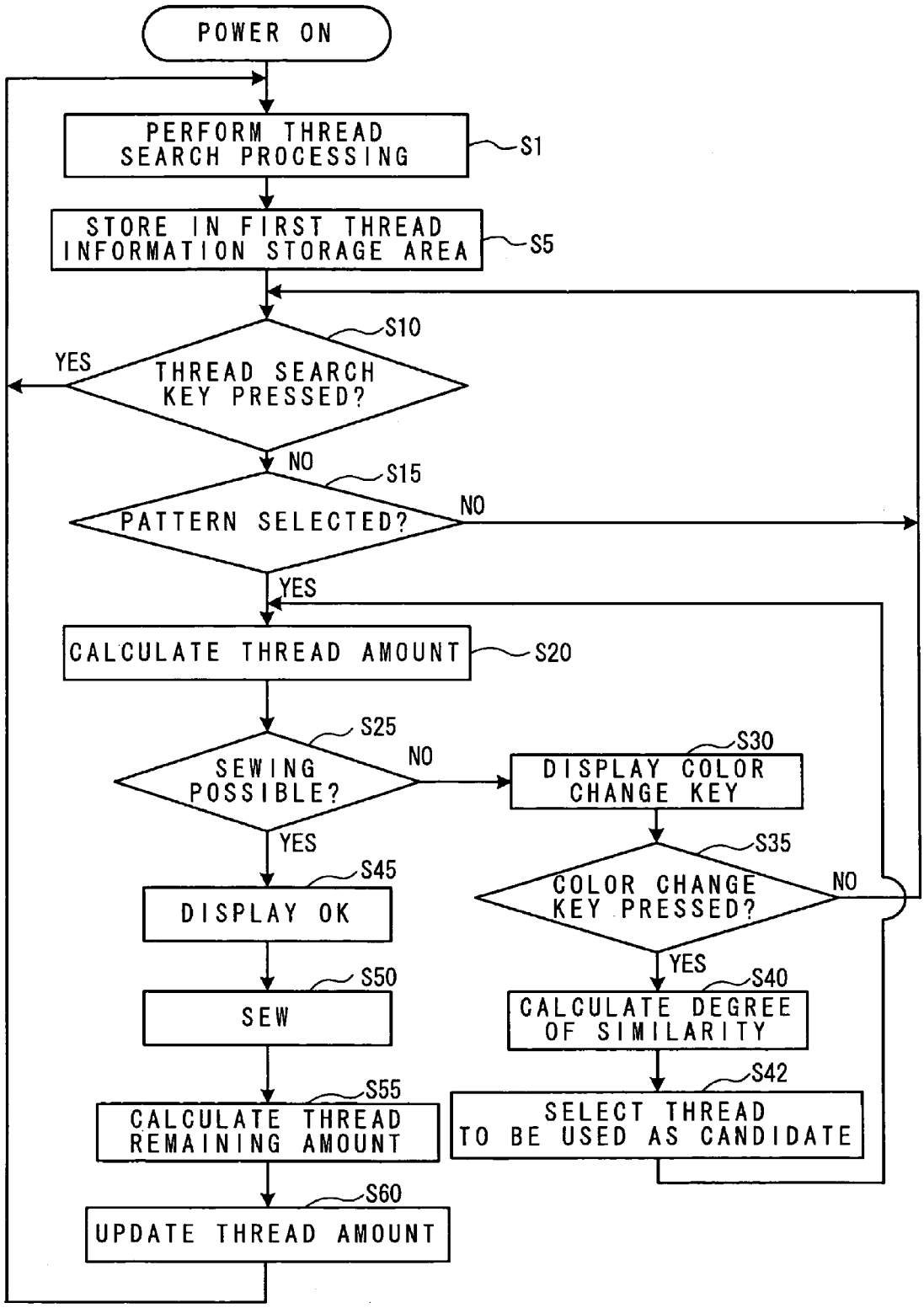
FIG. 10 is a flowchart of main processing for the sewing machine.

Main processing shown in FIG. 10 is started when power is applied to the sewing machine 1. Wireless communication is performed by the RFID reader/writer 510 with an RFID tag 801 that is embedded in a circular surface 213 of the thread spool 21 and thread information stored in the memory section 826 is read out in step 1 (S1). The read out thread information is stored in the first thread information storage area 1031 of the RAM 103 in step 5 (S5). Thread information of not only a thread spool 21, which is attached to the spool pin 16, but also all thread spools 21 that are placed in the communication range of the RFID reader/writer 510 are read out and stored, as shown in FIG. 5. For example, in the case of FIG. 5, eight thread spools 21 are in the communication range. Further, the thread colors and thread amounts of respective threads, which are wound around the eight thread spools, are 5 meters of a red thread, 30 meters of a pink thread, 100 meters of a blue thread, 20 meters of a yellow green thread, 1 meter of a white thread, 20 meters of a black thread, 30 meters of a salmon pink thread, and 3 meters of a green thread, respectively.

The CPU 101 determines whether a thread search key (not shown) is pressed in step 10 (S10). The thread search key is provided in a pattern selection screen and a sewing screen displayed on the LCD 10 and can be selected via the touch panel 111. If the thread search key is pressed (YES at S10), the CPU 101 returns to S1 to perform thread search processing.

Figure 11:
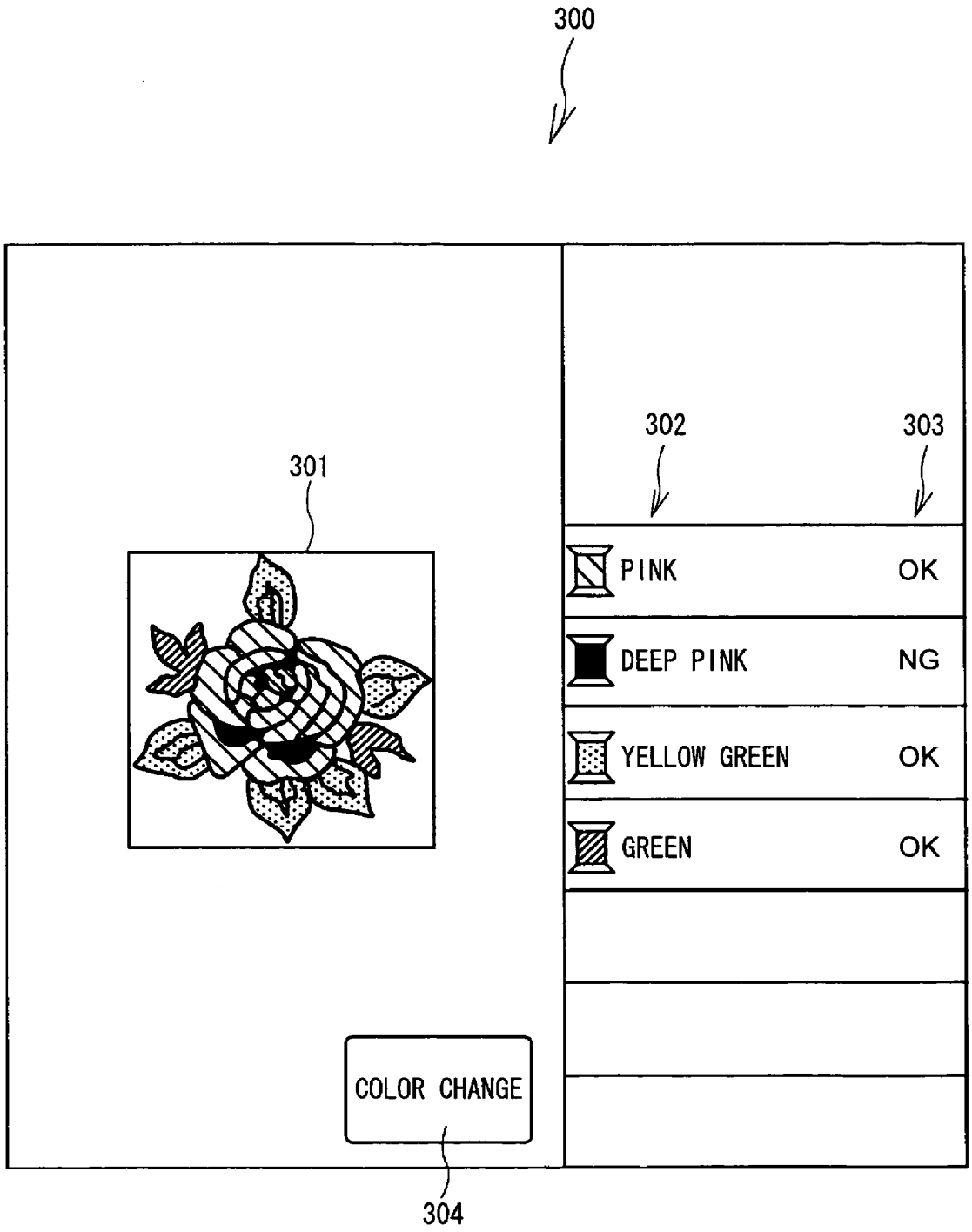
FIG. 11 is an explanatory illustration showing an example of a sewing screen.

If the thread search key is not pressed (NO at S10), the CPU 101 determines whether an embroidery pattern is selected in step 15 (S15). One of the embroidery patterns that are displayed on the LCD 10, can be selected by the user via the touch panel 111. Embroidery data of the selected embroidery pattern is stored in the selected pattern storage area 1033 of the RAM 103. Then, as shown in FIG. 11, a selected embroidery pattern 301 is displayed on the left side in a sewing screen 300. If an embroidery pattern is not selected (NO at S15), the CPU 101 returns to S10 to determine again whether the thread search key is pressed.

If an embroidery pattern is selected (YES at S15), the CPU 101 calculates a necessary thread amount for each thread to be used for the selected embroidery pattern in step 20 (S20). As described above, embroidery data includes relative coordinates with which an embroidery frame 32 is moved for respective stitches. Therefore, the CPU 101 adds a correction value as a margin to a total sum of movement distances, which are derived from the respective coordinates, thereby calculating the necessary thread amount. Then, the CPU 101 stores the calculated thread amount for each thread color in the second thread information storage area 1032. For example, if an embroidery pattern 301 of a rose, shown in FIG. 11, for example, is selected, the CPU 101 calculates a thread amount for each thread color and stores 5, 3, 10 and 2 meters for pink, deep pink, yellow green and green threads, respectively, in the second thread information storage area 1032, as shown in FIG. 6.

The CPU 101 compares the thread information stored in the first thread information storage area 1031 with the thread information stored in the second thread information storage area 1032, thereby determining whether the selected embroidery pattern can be sewn with the threads available in step 25 (S25). For example, the CPU 101 compares the thread information of FIG. 5 with the thread information of FIG. 6. Among the threads stored in the second thread information storage area 1032, pink, yellow green and green threads are also present in the first thread information storage area 1031. The remaining thread amounts are sufficient because the pink, yellow green and green threads are 30, 20 and 3 meters, respectively, and thread amounts to be used for respective colors are 5, 10 and 2 meters, respectively. However, a deep pink thread, which is stored in the second thread information storage area 1032, is not present in the first thread information storage area 1031. Therefore, the CPU 101 displays pink, deep pink, yellow green and green, which are colors of the threads stored in the second thread information storage area 1032, in a necessary thread display area 302, as shown in FIG. 11. In a sewing possibility display area 303, the CPU 101 displays "OK" for each of the colors, pink, yellow green, and green. "OK" indicates that sewing the selected embroidery pattern is possible with a thread of a corresponding color. The CPU 101 displays "NG" for deep pink. "NG" indicates that sewing the selected embroidery pattern is impossible with a thread of a corresponding color. Further, the CPU 101 displays a color change key 304 so as to be possible to be pressed in step 30 (S30). The color change key 304 can be pressed only if a thread is not available and thus sewing needed for the selected embroidery pattern is impossible.

In step 35 (S35), the CPU 101 determines whether the color change key 304 is pressed. If the color change key 304 is not pressed (NO at S35), sewing the selected embroidery pattern is impossible. Therefore, the CPU 101 returns to S10 to determine whether the thread search key is pressed. Sewing may be made possible in some cases if a user prepares another thread spool 21 other than thread spools, which have already been searched in the communication range of the RFID reader/writer 510, and then presses the thread search key to perform the thread search processing. In the above example, if the user prepares a thread spool 21 with a deep pink thread, the CPU 101 may determine that sewing is possible.

If the color change key 304 is pressed (YES at S35), the CPU 101 calculates a degree of similarity between the thread color of the thread with which sewing the selected embroidery pattern is impossible (hereinafter simply referred to as "lacking thread color") and each of thread colors of the threads stored in the first thread information storage area 1031 in step 40 (S40). Although the thread colors that are stored in the first thread information storage area 1031 and the second thread information storage area 1032 are indicated by names of the colors for simplicity of explanation, the RGB values of thread colors are actually stored. A degree of similarity D can be obtained from the RGB values of two threads. For example, it is supposed that the RGB values of the lacking thread color are (R1, G1, B1) and the RGB values of one of the thread colors stored in the first thread information storage area 1031 are (R2, G2, B2). The degree of similarity D between these thread colors can be obtained from the following formula: D=(R2−R1)2+(G2−G1)2+(B2−B1)2.

The smaller the obtained degree of similarity D is, the more similar the thread colors are, and hence the higher the degree of similarity is. At S40, the CPU 101 calculates the degree of similarity between a lacking thread color (deep pink in the above example) and each of the thread colors stored in the first thread information storage area 1031. The CPU 101 selects a thread color that has the smallest degree of similarity D with the lacking thread color as a candidate for sewing the selected embroidery pattern in step 42 (S42) and stores the selected thread color in the second thread information storage area 1032. For example, in the above example, from among the threads stored in the first thread information storage area 1031 of FIG. 5, a salmon pink thread has the highest degree of similarity D with the deep pink thread. The CPU 101 replaces the deep pink thread with the salmon pink thread as a candidate for sewing the embroidery pattern. The CPU 101 returns to S20 to calculate a thread amount of a thread that is selected as a candidate for sewing the embroidery pattern.

The second thread information storage area 1032 after the processing at S42 is shown in FIG. 12. The CPU 101 compares the thread information stored in the second thread information storage area 1032 with the thread information stored in the first thread information storage area 1031 to determine whether sewing the selected embroidery pattern is possible in step 25 (S25).

Figure 13:
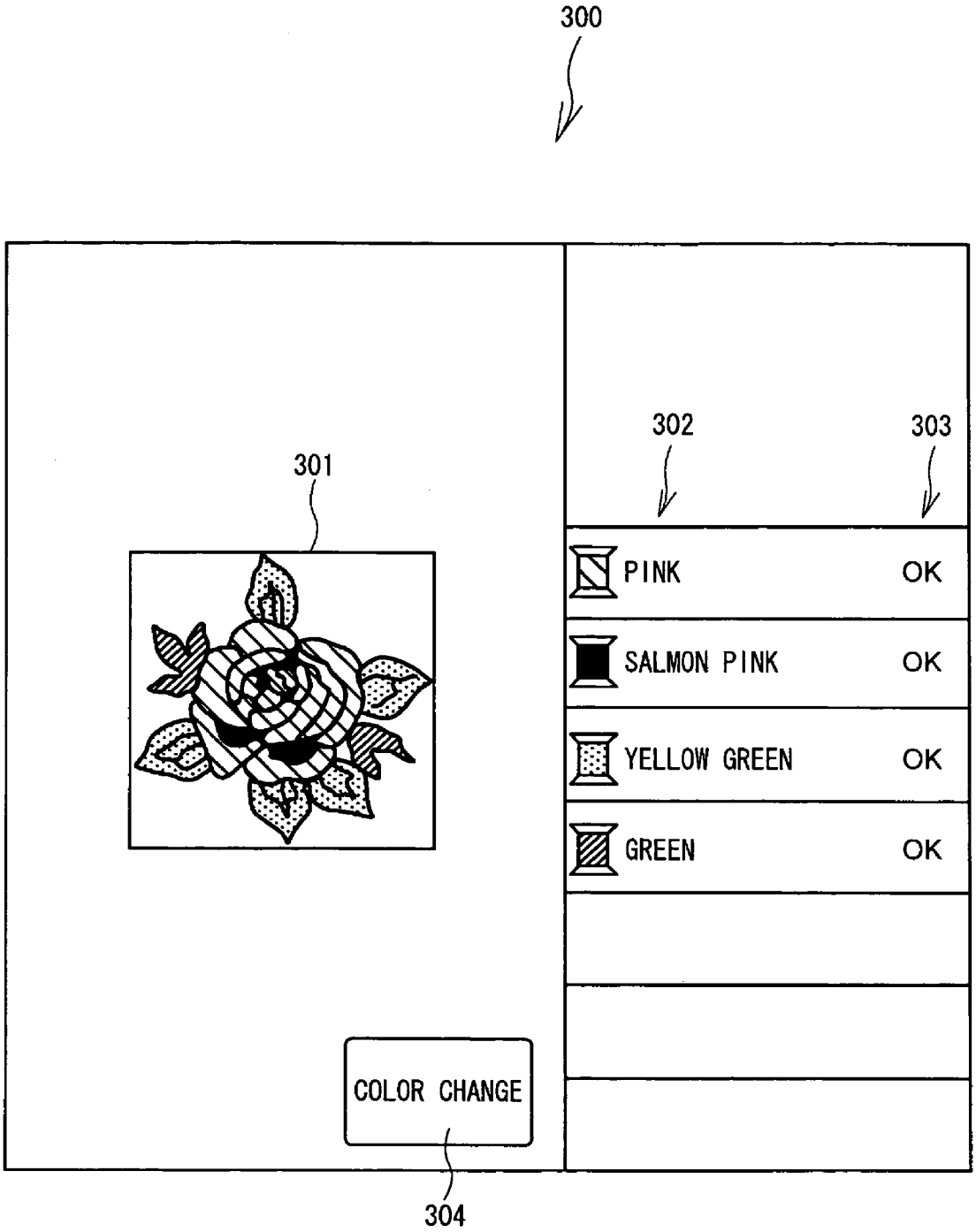
FIG. 13 is an explanatory illustration showing an example of a sewing screen after color change processing.

If sewing the selected embroidery pattern is possible (YES at S25), the CPU 101 displays "OK" in the sewing possibility display area 303 for each of the colors, as shown in FIG. 13 in step 45 (S45). If the start/stop key 91 is pressed, the CPU 101 performs sewing in step 50 (S50). In sewing, as described above, a thread amount of a thread, which has been used, is detected by the encoder 48 and stored as a used thread amount in the used thread amount storage area 1034 of the RAM 103 for each of the thread colors. After the sewing is completed, the CPU 101 subtracts the used thread amount stored in the used thread amount storage area 1034 from the thread amount stored in the first thread information storage area 1031, thereby calculating a remaining amount of the thread in step 55 (S55). In step 60 (S60), the CPU 101 performs thread amount update processing to write the calculated thread remaining amount into the RFID tag 801 of each of the thread spools 21 by the RFID reader/writer 510. Then, the CPU 101 returns to S1 to perform the thread search processing. The above processing may be repeated in the sewing machine 1.

In the above example, after the thread search processing is performed subsequent to the sewing (S50) and the thread amount update processing (S60), the thread amounts are updated in the first thread information storage area 1031, as shown in FIG. 14. For example, pink, yellow green, salmon pink, and green thread amounts are updated from 30 meters, 20 meters, 30 meters, and 3 meters to 25 meters, 10 meters, 27 meters, and 1 meter, respectively. If the same embroidery pattern 301 is selected in this condition, only 1 meter of the green thread is left although 2 meter of the green thread is necessary (See FIG. 12), so "NG" is displayed in the sewing possibility display area 303 for the green thread.

In the above processing, the CPU 101 determines whether sewing the selected embroidery pattern is possible at S25 and displays a result whether the sewing is possible in the sewing possibility display area 303 on the sewing screen 300. The CPU 101 can also directly display a result of a comparison between the thread information stored in the first thread information storage area 1031 and the thread information stored in the second thread information storage area 1032. A user can determine whether to perform color change processing or prepare another thread based on the result of the comparison.

As described above, according to the sewing machine 1 of the present example, if a plurality of thread spools 21 are in the communication range of the RFID reader/writer 510 of the sewing machine 1, thread information of the plurality of thread spools 21 is read out. In an RFID tag 801 which is embedded in each of the thread spools 21, the thread information including a thread color and a thread amount is stored. If the user selects an embroidery pattern to be sewn, necessary thread colors and necessary thread amounts are calculated from embroidery data for the selected embroidery pattern and compared with the thread information read out by the RFID reader/writer 510. Based on a result of a comparison, whether sewing the selected embroidery pattern is possible with thread spools 21 that are present near the sewing machine 1 is determined and the result is displayed. If the display indicates that the sewing is impossible, the user can prepare a thread spool 21 of a lacking thread color or select another embroidery pattern. If the user presses the color change key 304, the CPU 101 calculates a degree of similarity between the lacking thread color and colors of threads of thread spools 21 near the sewing machine 1. The CPU 101 then determines again whether sewing the embroidery pattern is possible when the thread spool 21 of the lacking color is substituted by a thread spool 21 of a thread color which has the highest degree of similarity. If the CPU 101 determines that the sewing is possible, the user can perform sewing with the thread with a similar color. Thus, the user can easily determine whether an embroidery pattern to be sewn can be sewn with thread colors and thread amounts of threads in hand. Further, the user can sew the embroidery pattern with an alternative thread. Therefore, the user can sew the embroidery pattern with less effort.

Thread information stored in the first thread information storage area 1031 can also be displayed in a list on the LCD 10. In this case, a user can confirm each thread amount of thread spools 21 in hand. Therefore, the user can easily know whether there is a thread spool 21 which has an insufficient remaining amount of a thread and hence a thread needs to be replenished.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine capable of sewing an embroidery pattern based on embroidery data including at least thread color data and needle drop point data, the thread color data identifying a color of an embroidery thread, the needle drop point data identifying a sewing position, the sewing machine comprising:

a reader that reads out thread information stored in an RFID tag embedded in each of a plurality of thread spools, the thread information including at least a thread color and a thread amount of a thread wound around each of the plurality of thread spools;

a selection device that selects the embroidery pattern;

a thread color-and-amount acquisition device that acquires a necessary thread color and a necessary thread amount from the embroidery data of a selected pattern, the necessary thread color being a thread color to be used for the selected pattern, the necessary thread amount being a thread amount to be used for the selected pattern, the selected pattern being the embroidery pattern selected by the selection device;

a comparison device that compares a read out thread amount with the necessary thread amount, the read out thread amount being the thread amount read out by the reader for each of the plurality of thread spools, the necessary thread amount being acquired by the thread color-and-amount acquisition device for the necessary thread color;

a determination device that determines whether sewing the selected pattern is possible based on a comparison result by the comparison device;

an indication device that indicates a determination result by the determination device;

a thread amount detection device that detects an amount of used thread as a used thread amount for a used thread spool among the plurality of thread spools, the used thread spool having been used in embroidery sewing;

a thread remaining amount calculation device that calculates a thread remaining amount from the read out thread amount read out by the reader and the used thread amount detected by the thread amount detection device, the thread remaining amount being a thread amount remaining on the used thread spool; and a writer that writes the thread remaining amount calculated by the thread remaining amount calculation device into the RFID tag of the used thread spool.

2. A sewing machine capable of sewing an embroidery pattern based on embroidery data including at least thread color data and needle drop point data, the thread color data identifying a color of an embroidery thread, the needle drop point data identifying a sewing position, the sewing machine comprising:

a reader that reads out thread information stored in an RFID tag embedded in each of a plurality of thread spools, the thread information including at least a thread color and a thread amount of a thread wound around each of the plurality of thread spools;

a selection device that selects the embroidery pattern;

a thread color-and-amount acquisition device that acquires a necessary thread color and a necessary thread amount from the embroidery data of a selected pattern, the necessary thread color being a thread color to be used for the selected pattern, the necessary thread amount being a thread amount to be used for the selected pattern, the selected pattern being the embroidery pattern selected by the selection device;

a comparison device that compares a read out thread amount with the necessary thread amount, the read out thread amount being the thread amount read out by the reader for each of the plurality of thread spools, the necessary thread amount being acquired by the thread color-and-amount acquisition device for the necessary thread color;

a determination device that determines whether sewing the selected pattern is possible based on a comparison result by the comparison device;

an indication device that indicates a determination result by the determination device;

a similarity determination device that determines a degree of similarity between the necessary thread color acquired by the thread color-and-amount acquisition device and the thread color read out by the reader for each of the plurality of thread spools;

a candidate selection device that selects a thread color similar to the necessary thread color from among the read out thread colors based on a determination result by the similarity determination device; and a thread color determination device that determines the thread color selected by the candidate selection device as a thread color to be used in embroidery sewing if the determination device determines that the sewing the selected pattern is impossible.

3. A computer-readable recording medium storing a thread amount processing program, the program comprising instructions that cause a controller to perform:

a thread color-and-amount acquisition step of acquiring a necessary thread color and a necessary thread amount from embroidery data including thread color data and needle drop point data for a selected embroidery pattern, the necessary thread color being a thread color to be used for the selected embroidery pattern, the necessary thread amount being a thread amount to be used for the selected embroidery pattern, the thread color data identifying a color of an embroidery thread, and the needle drop point data identifying a sewing position;

a comparison step of comparing a read out thread amount with the necessary thread amount, the read out thread amount being a thread amount read out from an RFID tag for each of a plurality of thread spools, the necessary thread amount being acquired in the thread color-and-amount acquisition step for each necessary thread colors, the RFID tag being embedded in each of the plurality of thread spools and storing thread information including at least a thread color and a thread amount of a thread wound around each of the plurality of thread spools;

a determination step of determining whether sewing the selected pattern is possible based on a comparison result in the comparison step;

an indication step of indicating a determination result in the determination step;

a thread remaining amount calculation step of calculating a thread remaining amount from the read out thread amount and a used thread amount, the thread remaining amount being an thread amount remaining on a used thread spool, the used thread amount being an amount of used thread for the used thread spool of the plurality of thread spools, the used thread spool having been used in embroidery sewing; and a writing step of writing the thread remaining amount calculated in the thread remaining amount calculation step into the RFID tag of each of the used thread spools.

4. A computer-readable recording medium storing a thread amount processing program, the program comprising instructions that cause a controller to perform:

a thread color-and-amount acquisition step of acquiring a necessary thread color and a necessary thread amount from embroidery data including thread color data and needle drop point data for a selected embroidery pattern, the necessary thread color being a thread color to be used for the selected embroidery pattern, the necessary thread amount being a thread amount to be used for the selected embroidery pattern, the thread color data identifying a color of an embroidery thread, and the needle drop point data identifying a sewing position;

a comparison step of comparing a read out thread amount with the necessary thread amount, the read out thread amount being a thread amount read out from an RFID tag for each of a plurality of thread spools, the necessary thread amount being acquired in the thread color-and-amount acquisition step for each necessary thread colors, the RFID tag being embedded in each of the plurality of thread spools and storing thread information including at least a thread color and a thread amount of a thread wound around each of the plurality of thread spools;

a determination step of determining whether sewing the selected pattern is possible based on a comparison result in the comparison step;

an indication step of indicating a determination result in the determination step;

a similarity determination step of determining a degree of similarity between the necessary thread color acquired in the thread color-and-amount acquisition step and a read out thread color read out from the RFID tag for each of the plurality of thread spools;

a candidate selection step of selecting a thread color similar to the necessary thread color from among the read out thread colors based on a determination result in the similarity determination step; and a thread color determination step of determining the thread color selected in the candidate selection step as a thread color to be used in embroidery sewing if it is determined in the determination step that the sewing the selected pattern is impossible.

* * * * *